US010782638B2

(12) United States Patent
Kato et al.

(10) Patent No.: US 10,782,638 B2
(45) Date of Patent: Sep. 22, 2020

(54) HEATER AND IMAGE FORMING APPARATUS

(71) Applicant: Toshiba Lighting & Technology Corporation, Yokosuka-shi, Kanagawa-ken (JP)

(72) Inventors: Satoko Kato, Yokosuka (JP); Kentaro Kimura, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 16/543,785

(22) Filed: Aug. 19, 2019

(65) Prior Publication Data

US 2020/0225608 A1 Jul. 16, 2020

(30) Foreign Application Priority Data

Jan. 11, 2019 (JP) ..... 2019-003779

(51) Int. Cl.
*G03G 15/20* (2006.01)
*H01C 7/00* (2006.01)

(52) U.S. Cl.
CPC ..... *G03G 15/2057* (2013.01); *G03G 15/2064* (2013.01); *H01C 7/008* (2013.01); *G03G 2215/2019* (2013.01)

(58) Field of Classification Search
CPC ..... G03G 15/2057; G03G 15/2064; G03G 2215/2019; H01C 7/008
See application file for complete search history.

(56) References Cited

U.S. PATENT DOCUMENTS 6,066,271 A * 5/2000 Hormadaly ..... H01C 17/0654 252/521.2
2002/0175154 A1* 11/2002 Karube ..... G03G 15/2064 219/216
2017/0003632 A1* 1/2017 Jensen ..... G03G 15/2053
2018/0032004 A1* 2/2018 Miyahara ..... G03G 15/206

FOREIGN PATENT DOCUMENTS

JP 61098372 A * 5/1986 ..... G03G 15/2028
JP 2003-240647 A 8/2003

OTHER PUBLICATIONS

Jagtap et al., Synthesis, Characterization and Fabrication of NTC Thick Film Thermistor Using Lead Free Glass Frit, Journal of Materials Science and Engineering. (Year: 2016).*

* cited by examiner

*Primary Examiner* — Susan S Lee
(74) *Attorney, Agent, or Firm* — Banner & Witcoff, Ltd.

(57) ABSTRACT

A heater of an embodiment includes a substrate, a resistance heating element, and a thermistor. The substrate includes a first surface and a second surface located on the side opposite to the first surface. The resistance heating element is disposed on the first surface. The thermistor is disposed on the second surface and does not contain lead.

13 Claims, 4 Drawing Sheets

| SUM OF MASS CONTENTS OF MANGANESE, COBALT, AND COPPER [mass%] | OCCURRENCE OF PEELING (UNPEELED STATE: ○, PEELED STATE: ×) |
|---|---|
| 60 | ○ |
| 65 | ○ |
| 70 | ○ |
| 75 | × |
| 80 | × |

HEATER AND IMAGE FORMING APPARATUS

CROSS-REFERENCE TO RELATED APPLICATIONS

This application claims the benefit of the priority of Japanese Patent Application No. 2019-003779, filed on Jan. 11, 2019, the entire content of which is incorporated herein by reference.

FIELD

Embodiments described herein relate generally to a heater and an image forming apparatus.

BACKGROUND

For example, there is known a heater used to fix toner in copying machines, facsimiles, and the like and to delete printing in a rewritable card reader and the like. The heater generates heat from a resistance heating element formed on one surface of a substrate by power supplied from an electrode for power supply. Further, a thermistor is disposed on the other surface of the substrate. The heater is adjusted to an appropriate temperature while the supply of power is controlled on the basis of a temperature detected by the thermistor.

Since such a heater contains lead as a component constituting the thermistor, there has been a demand for designing the thermistor in consideration of the environment.

A problem to be solved in the disclosure is to provide a heater and an image forming apparatus which are contrived in consideration of the environment.

DETAILED DESCRIPTION

Figure 1:
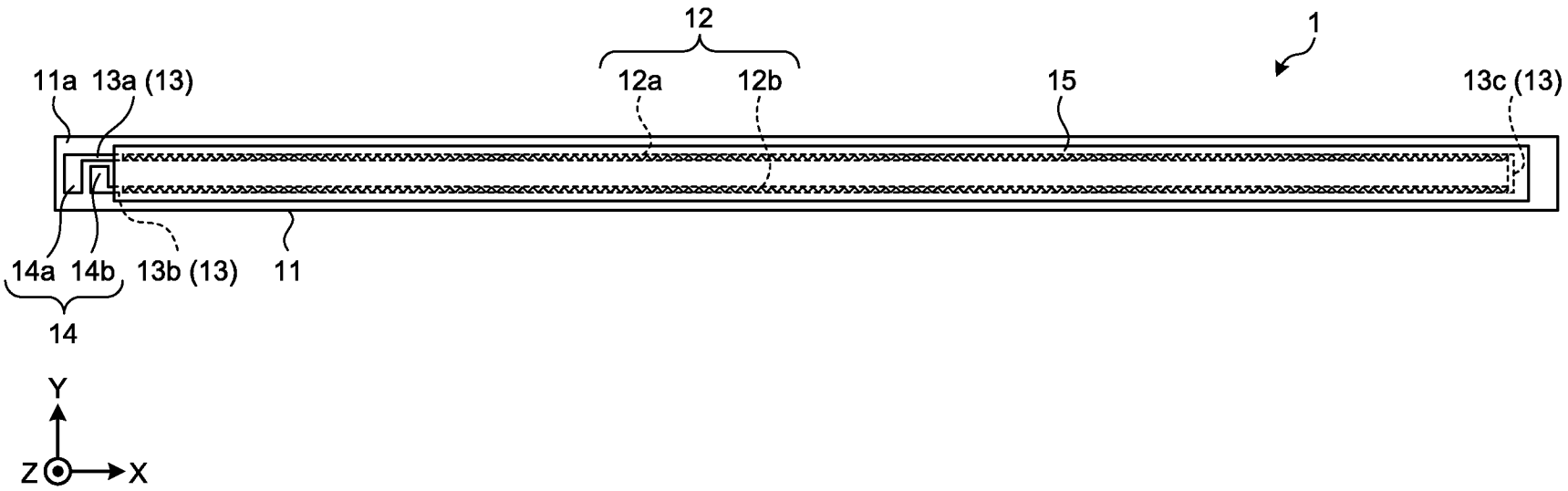
FIG. 1 is a plan view illustrating a heater according to an embodiment, seen from a first surface side of a substrate.

A heater 1 according to an embodiment to be described below includes a substrate 11, a resistance heating element 12, and a thermistor 16. The substrate 11 includes a first surface 11*a* and a second surface 11*b* located on the side opposite to the first surface 11*a*. The resistance heating element 12 is disposed on the first surface 11*a*. The thermistor 16 is disposed on the second surface 11*b* and does not contain lead.

Further, the thermistor 16 according to the embodiment to be described below contains manganese, cobalt, and any one or both of copper and nickel.

Further, in the thermistor 16 according to the embodiment to be described below, the mass content becomes larger in order of the manganese, the cobalt, and any one or both of the copper and the nickel.

Further, in the thermistor 16 according to the embodiment to be described below, the mass contents of the manganese and the cobalt are larger than the mass contents of other components.

Further, in the thermistor 16 according to the embodiment to be described below, the sum of mass contents of the manganese, the cobalt, the copper, and the nickel is 50 mass % or more and 70 mass % or less.

Further, the thermistor 16 according to the embodiment to be described below contains ruthenium of 2 mass % or more and 15 mass % or less.

Further, a copying machine 100 which is an image forming apparatus according to the embodiment to be described later includes the heater 1 which heats a passing medium and a pressing roller 203 which presses a medium in a heating state and heats and presses the medium by the pressing roller 203 so that a toner image adhering to the medium is fixed.

Embodiments

Figure 2:
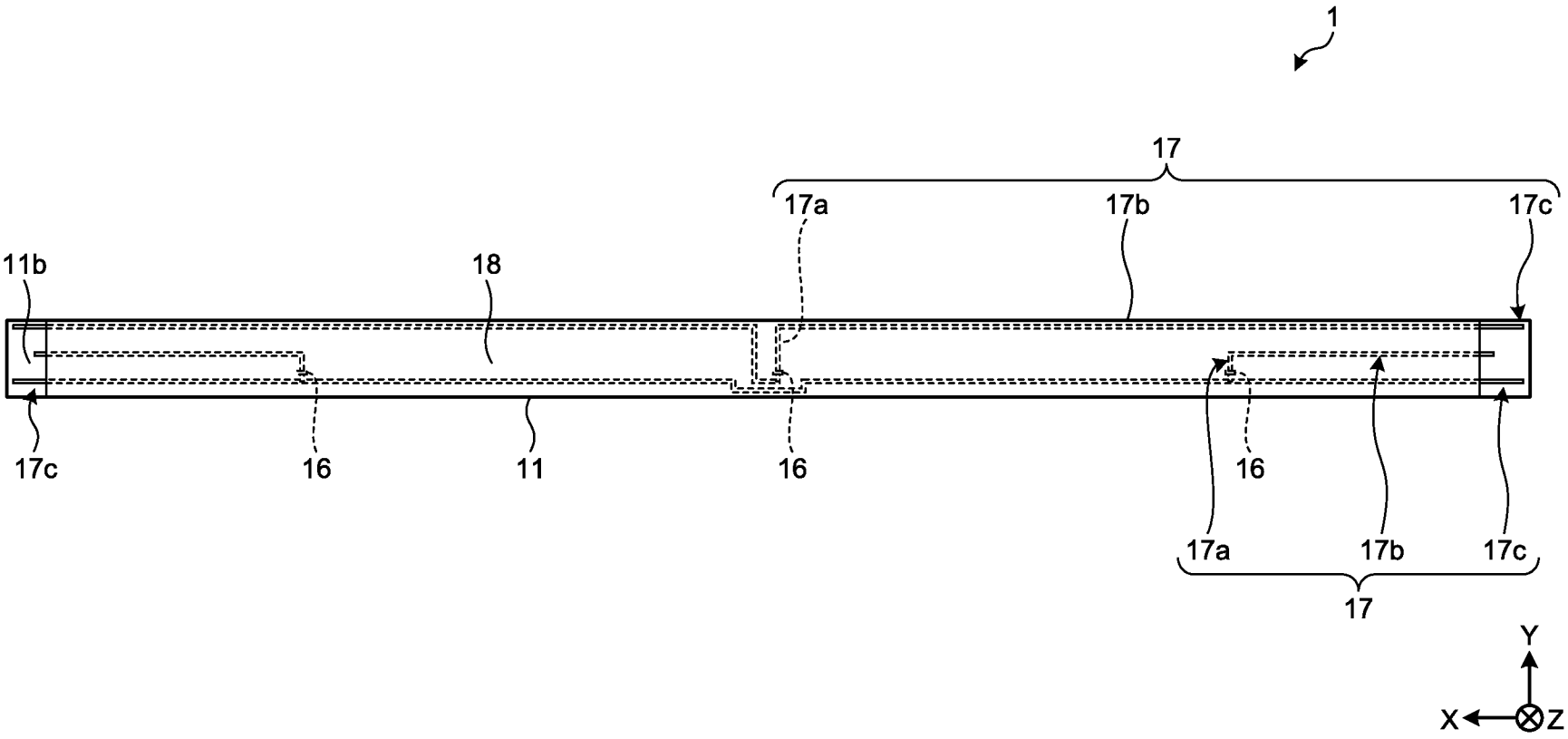
FIG. 2 is a plan view illustrating the heater according to the embodiment, seen from a second surface side of the substrate.

The heater according to the embodiment will be described with reference to the drawings. FIG. 1 is a plan view illustrating the heater according to the embodiment, seen from the first surface side of the substrate. FIG. 2 is a plan view illustrating the heater according to the embodiment, seen from the second surface side of the substrate. Additionally, in order to easily understand the description, FIGS. 1 and 2 illustrate a three-dimensional orthogonal coordinate system having a Z axis in which the first surface side of the substrate is a positive direction and the second surface side thereof is a negative direction.

The heater 1 according to the embodiment is mounted on electronic apparatuses and mainly heats a medium such as paper passing through the electronic apparatuses. The heater 1 includes, as illustrated in FIG. 1, the substrate 11, the resistance heating element 12, a first conductor 13, a power-supply electrode 14, and a coating layer 15. Further, the heater 1 includes, as illustrated in FIG. 2, a plurality of thermistors 16, a second conductor 17, and a coating layer 18.

The substrate 11 has heat resistance and insulation and is formed in an elongated rectangular shape in the embodiment. The substrate 11 is a flat plate which is formed of, for example, ceramics such as alumina or aluminum nitride, glass ceramics, or heat resistant composite materials. The substrate 11 has a thickness corresponding to a space where the heater 1 is attached and the thickness is, for example, about 0.5 mm to 1.0 mm. Additionally, the shape of the substrate 11 is not limited thereto as long as a longitudinal direction (an X-axis direction) and a width direction (a Y-axis direction) intersecting the longitudinal direction are provided. For example, a recess, a protrusion, a chip, or the like may be formed on the outer periphery.

The resistance heating element 12 is electrically connected to the first conductor 13 and is provided on the first surface 11*a* of the substrate 11 in the thickness direction (the Z-axis direction). The resistance heating element 12 generates heat when power is supplied thereto. The resistance heating element 12 is a heating element pattern which is formed of a heating element paste of, for example, a silver-palladium type, a graphite type, or a ruthenium oxide type. In the embodiment, the resistance heating element 12 is disposed in the X-axis direction. A resistance heating element 12*a* and a resistance heating element 12*b* included in the resistance heating element 12 are disposed so as to be separated from each other in the Y-axis direction. The resistance heating elements 12*a* and 12*b* are respectively disposed in a band shape in the longitudinal direction so that the length of the heater 1 in the width direction is uniform.

The first conductor 13 is used to supply power to the resistance heating element 12 and is provided on the first surface 11*a* of the substrate 11. The first conductor 13 is, for example, a conductor pattern which is formed on the first surface 11*a* by a conductor paste such as silver (Ag). The first conductor 13 of the embodiment is electrically connected to the resistance heating element 12 in the X-axis direction which is the longitudinal direction of the heater 1 (the substrate 11). A conductor 13*a*, a conductor 13*b*, and a conductor 13*c* of the first conductor 13 are provided so as to be separated from one another in the X-axis direction and the resistance heating elements 12*a* and 12*b* are respectively disposed therebetween. The conductor 13*a* is formed in the longitudinal direction of the resistance heating element 12*a*, one end portion thereof is electrically connected to an electrode 14*a*, and the other end portion thereof is electrically connected to one end portion of the resistance heating element 12*a*. The conductor 13*b* is formed in the longitudinal direction of the resistance heating element 12*b*, one end portion thereof is electrically connected to an electrode 14*b*, and the other end portion thereof is electrically connected to one end portion of the resistance heating element 12*b*. The conductor 13*c* is electrically connected to each of the other end portions of the resistance heating elements 12*a* and 12*b*. That is, the first conductor 13 is electrically connected in the longitudinal direction of the resistance heating element 12. The power-supply electrode 14 is electrically connected to the first conductor 13 and is provided on the first surface 11*a* of the substrate 11. As illustrated in FIG. 1, a pair of the electrodes 14*a* and 14*b* included in the power-supply electrode 14 is provided at the end portion of the substrate 11 in the X-axis direction. The pair of electrodes 14*a* and 14*b* is respectively electrically connected to the conductors 13*a* and 13*b* so that a current flows to the conductors 13*a* and 13*b*. Additionally, in FIG. 1, the pair of electrodes 14*a* and 14*b* is provided at one end portion of the substrate 11, but the pair of electrodes 14*a* and 14*b* may be respectively provided at both end portions or the other end portion. In general, the pair of electrodes 14*a* and 14*b* is formed on the first surface 11*a* of the substrate 11 so as to be respectively integrated with the conductors 13*a* and 13*b*, but the pair of electrodes 14*a* and 14*b* and the conductors 13*a* and 13*b* may be formed respectively separately. Further, the pair of electrodes 14*a* and 14*b* is disposed on the first surface 11*a* provided with the conductors 13*a* and 13*b* in the substrate 11, but the pair of electrodes 14*a* and 14*b* may be disposed on the second surface 11*b* on the side opposite to the surface provided with the conductors 13*a* and 13*b*. In this case, the pair of electrodes 14*a* and 14*b* is respectively electrically connected to the conductors 13*a* and 13*b* through a through-hole formed in the substrate 11.

The coating layer 15 is a protection layer and covers the resistance heating element 12 and the first conductor 13 provided on the first surface 11*a* of the substrate 11. The coating layer 15 is formed in a band shape in the embodiment. Since the coating layer 15 covers the resistance heating element 12 and the first conductor 13, it is possible to prevent the resistance heating element 12 and the first conductor 13 from being directly exposed to the atmosphere. Accordingly, it is possible to suppress the resistance heating element 12 and the first conductor 13 from being damaged and broken due to an external interference (for example, mechanical, chemical, and electrical interference).

The thermistor 16 is a temperature detection element for detecting the temperature of the substrate 11. As illustrated in FIG. 2, the thermistor 16 is provided at a plurality of positions of the second surface 11*b* of the substrate 11 in the longitudinal direction of the substrate 11. That is, the thermistor 16 is disposed at the center and both end sides of the substrate 11 in the longitudinal direction of the substrate 11. In this way, it is possible to detect a temperature at a plurality of positions in the longitudinal direction of the substrate 11 by the plurality of thermistors 16 in the heater 1. The thermistor 16 is a printed thermistor which is directly disposed on the second surface 11*b* of the substrate 11. For this reason, it is possible to obtain faster temperature sensing and superior temperature control response as compared with a so-called chip thermistor. Further, the thermistor 16 has a high degree of freedom in size or arrangement as compared with the chip thermistor. Additionally, detailed characteristics or compositions of the thermistor 16 will be described below.

The second conductor 17 is a band-shaped thermistor conductor which corresponds to a plurality of conductors supplying power to the plurality of thermistors 16. As illustrated in FIG. 2, the second conductor 17 includes a connection portion 17*a* which is connected to the thermistor 16, a linear conductive portion 17*b* which extends in the longitudinal direction (the X-axis direction) of the substrate 11, and an electrode portion 17*c* which is connected to each terminal member (not illustrated) supplying power. Further, the second conductor 17 electrically connects the thermistors 16.

The connection portion 17*a* includes a portion which extends in the width direction (the Y-axis direction) of the substrate 11 and is connected to one end portion of the conductive portion 17*b*. Since the connection portion 17*a* extends in this way, the position of the conductive portion 17*b* with respect to the width direction of the substrate 11 is adjusted. The conductive portion 17*b* extends to the end portion of the substrate 11 in the longitudinal direction (the X-axis direction) of the substrate 11. A plurality of the conductive portions 17*b* are arranged at intervals in the width direction of the substrate 11.

The electrode portion 17*c* is formed at the other end portion of the conductive portion 17*b* extending to the end portion of the substrate 11 in the longitudinal direction (the X-axis direction). The electrode portion 17*c* is formed at the end portions of the substrate 11 in the longitudinal direction with a gap interposed therebetween in the longitudinal direction of the substrate 11. The electrode portion 17*c* supplies power to the thermistor 16 through a terminal member (not illustrated) by the connection to the terminal member connected to a power-supply unit (not illustrated) of an electronic apparatus such as an image forming apparatus.

The coating layer 18 is a protection layer which coats the thermistor 16 and the second conductor 17 provided on the second surface 11*b* of the substrate 11. The material of the coating layer 18 can be the same as that of the coating layer 15. In the embodiment, the coating layer 18 is formed in a band shape so as to cover the entire substrate 11 in the width direction (the Y-axis direction). Further, both ends of the substrate 11 in the longitudinal direction (the X-axis direction) without the coating layer 18 in the second conductor 17 are the electrode portions 17*c*.

The number and arrangement of the resistance heating elements 12 or the thermistors 16 of the heater 1 and the configurations of the first conductor 13 and the second conductor 17 are not limited to the configurations illustrated in FIGS. 1 and 2 and may be changed in response to the application or performance of the heater 1.

In the heater 1 according to the embodiment, the sheet resistance of the thermistor 16 disposed on the second surface 11*b* of the substrate 11 can be 100 kΩ/□ to 10000 kΩ/□. The resistance value of the thermistor 16 is generally a high value of the order of kΩ/□ or more, but in the range of the sheet resistance, for example, the measurement can be performed without any influence on the resistance measurement accuracy. Accordingly, desirable thermistor performance is obtained. Further, the thermistor 16 can set the B constant to −2700 K or less. Here, the "B constant" is a physical property value that indicates the sensitivity of the thermistor 16 with respect to a temperature change. When the thermistor 16 has such a physical property value, the temperature of the substrate 11 can be accurately detected.

Further, the thermistor 16 according to the embodiment does not contain lead (Pb). For this reason, it is possible to provide the heater 1 with the thermistor 16 in consideration of the environment. Here, a "case in which lead is not contained" means that the content of lead measured by an electron probe microanalyzer (EPMA) JXA-8200 (manufactured by JEOL Ltd.) is a detection limit or less after the thermistor 16 disposed on the second surface 11*b* is cut in the thickness direction of the substrate 11. Further, the contents and mass contents of the components in the thermistor 16 to be described later can be also measured similarly to the content of the lead.

Further, the thermistor 16 according to the embodiment contains manganese, cobalt, and any one or both of copper and nickel and does not contain lead. For this reason, it is possible to provide the heater 1 with the thermistor 16 capable of accurately detecting the temperature of the substrate 11 in consideration of the environment.

Further, in the thermistor 16 according to the embodiment, mass contents become larger in order of manganese, cobalt, and any one or both of copper and nickel and lead is not contained. For this reason, it is possible to provide the heater 1 with the thermistor 16 capable of accurately detecting the temperature of the substrate 11 in consideration of the environment.

Further, in the thermistor 16, the mass contents of manganese and cobalt are larger than the mass contents of other components. For this reason, it is possible to provide the heater 1 with the thermistor 16 capable of accurately detecting the temperature of the substrate 11 in consideration of the environment.

Further, in the thermistor 16 according to the embodiment, the sum of mass contents of manganese, cobalt, copper, and nickel is 50 mass % or more and 70 mass % or less. When the sum of mass contents is smaller than 50 mass %, the B constant exceeds −2700 K and hence the thermistor 16 cannot accurately detect the temperature of the substrate 11. Meanwhile, when the sum of mass contents exceeds 70 mass %, the contents of other components contained in the thermistor 16, for example, glass mixed to be bound to the substrate 11 decreases, so that the adhesion strength is affected. Alternatively, the amount of conductive materials for controlling the resistance decreases, so that the resistance increases.

Further, the thermistor 16 according to the embodiment contains ruthenium of 2 mass % or more and 15 mass % or less. Since the sheet resistance of the thermistor 16 is out of the range of 100 kΩ/□ to 10000 kΩ/□ when the content of ruthenium is smaller than 2 mass % or larger than 15 mass %, the temperature of the substrate 11 cannot be accurately detected.

Here, a relationship between the physical property of the thermistor 16 and the sum of mass contents of manganese, cobalt, and copper will be described. The physical property of the thermistor 16, particularly, the occurrence of peeling was tested by changing the sum of mass contents of manganese, cobalt, and copper. The test was performed on the thermistor 16 of which the sum of mass contents of manganese, cobalt, and copper was changed to 60 mass %, 65 mass %, 70 mass %, 75 mass %, and 80 mass % so as to visually check the occurrence of pattern peeling when a pin with epoxy resin adhesive (area ϕ 2 mm) on one side was bonded to the thermistor 16 and was pulled horizontally. Additionally, observing no pattern peeling is demanded as a result of the peeling test.

Figures 3, 4:
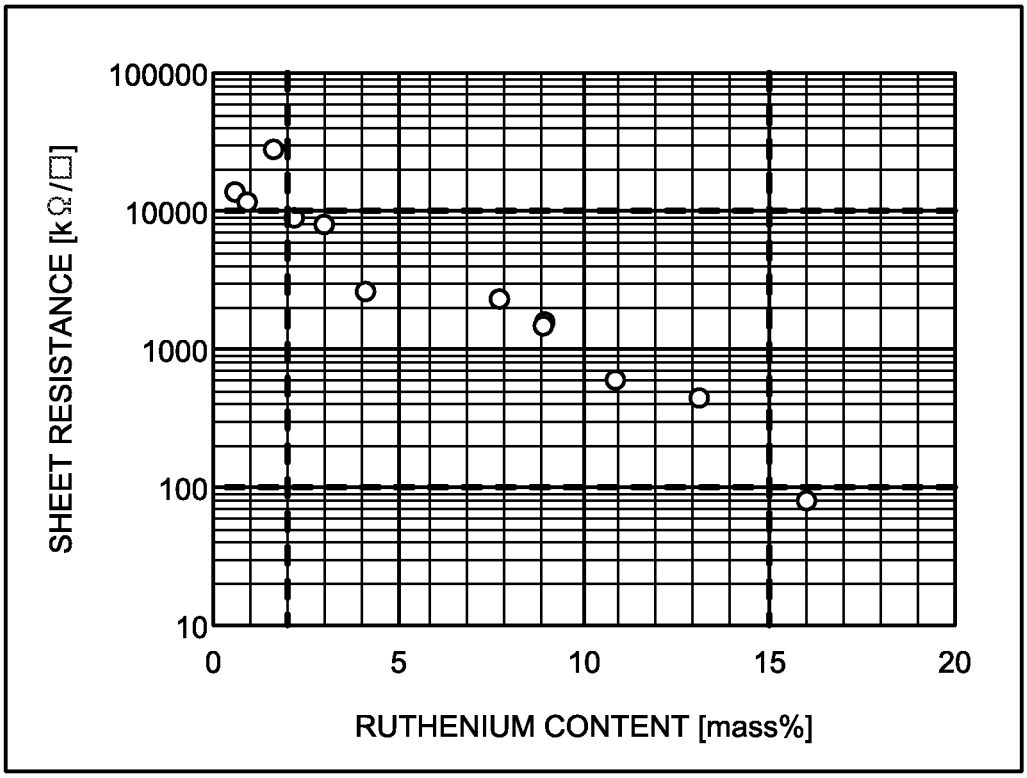
FIG. 3 is a diagram showing a result of a peeling test for a thermistor.
FIG. 4 is a diagram showing a relationship between a sheet resistance kg/□ and content mass % of ruthenium contained in the thermistor.

The test result is shown in FIG. 3. In FIG. 3, a "case without the pattern peeling" is expressed by "○" and a "case with the pattern peeling" is expressed by "x". As obvious from FIG. 3, it was proved that no pattern peeling occurred when the sum of mass contents of manganese, cobalt, and copper was 60 mass %, 65 mass %, and 70 mass %, that is, the sum of mass contents of manganese, cobalt, and copper is 70 mass % or less and hence no problem occurred in the thermistor 16. Meanwhile, since the pattern peeling occurred when the sum of mass contents of manganese, cobalt, and copper exceeded 70 mass %, that is, the sum of mass contents of manganese, cobalt, and copper was 75 mass % and 80 mass %, a problem was found in the thermistor 16. From the description above, the sum of mass contents of manganese, cobalt, and copper is desirably 70 mass % or less.

Further, the same result as the thermistor 16 shown in FIG. 3 could be obtained even in the thermistor 16 containing manganese, cobalt, and nickel and the thermistor 16 containing manganese, cobalt, copper, and nickel. From the description above, the sum of mass contents of manganese, cobalt, copper, and nickel is desirably 70 mass % or less.

Next, a relationship between the sheet resistance kΩ/□ and the content mass % of ruthenium contained in the thermistor 16 was tested. The test result is shown in FIG. 4. In FIG. 4, a horizontal axis indicates the content mass % of ruthenium and a vertical axis indicates the sheet resistance kΩ/□. Additionally, the sheet resistance kΩ/□ is a measurement result under the condition of 25° C. As obvious from FIG. 4, it was proved that the content of ruthenium when the sheet resistance of the thermistor 16 was in the range of 100 kΩ/□ to 10000 kΩ/□ was 2 mass % or more and 15 mass % or less.

As described above, the heater 1 according to the embodiment includes the substrate 11, the resistance heating element 12, and the thermistor 16. The substrate 11 includes the first surface 11*a* and the second surface 11*b* located on the side opposite to the first surface 11*a*. The resistance heating element 12 is disposed on the first surface 11*a*. The thermistor 16 is disposed on the second surface 11*b* and does not contain lead. For this reason, it is possible to provide the heater 1 in consideration of the environment.

Further, the thermistor 16 according to the embodiment contains manganese, cobalt, and any one or both of copper and nickel. For this reason, it is possible to provide the heater 1 capable of accurately detecting the temperature of the substrate 11 in consideration of the environment.

Further, in the thermistor 16 according to the embodiment, mass contents become larger in order of the manganese, the cobalt, and any one or both of the copper and the nickel. For this reason, it is possible to provide the heater 1 capable of accurately detecting the temperature of the substrate 11 in consideration of the environment.

Further, in the thermistor 16 according to the embodiment, the mass contents of the manganese and the cobalt are larger than the mass contents of other components. For this reason, it is possible to provide the heater 1 capable of accurately detecting the temperature of the substrate 11 in consideration of the environment.

Further, in the thermistor 16 according to the embodiment, the sum of mass contents of the manganese, the cobalt, the copper, and the nickel is 50 mass % or more and 70 mass % or less. For this reason, it is possible to provide the heater 1 capable of accurately detecting the temperature of the substrate 11 in consideration of the environment.

Further, the thermistor 16 according to the embodiment contains ruthenium of 2 mass % or more and 15 mass % or less. For this reason, it is possible to provide the heater 1 capable of accurately detecting the temperature of the substrate 11 in consideration of the environment.

Configuration of Fixing Device

Figure 5:
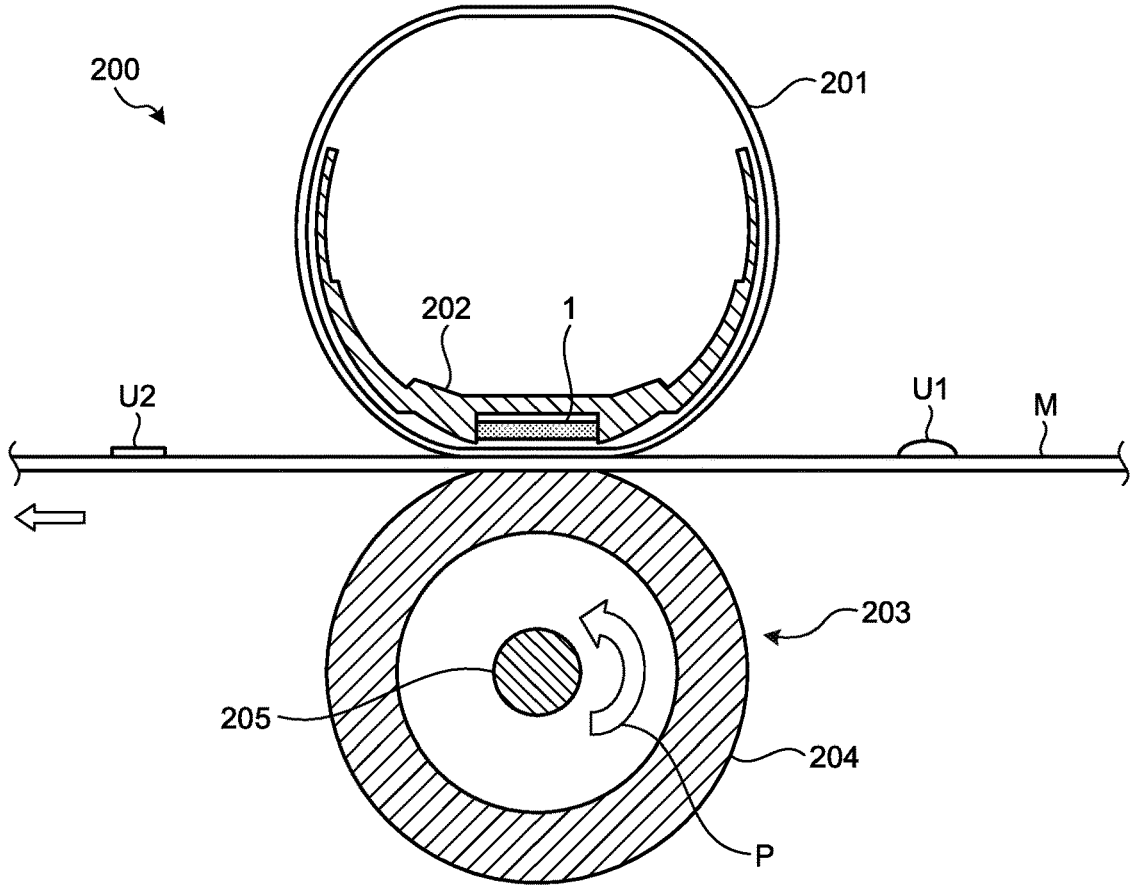
FIG. 5 is a cross-sectional view illustrating a fixing device of the embodiment that uses the heater according to the embodiment.

Next, a fixing device of the embodiment using the heater 1 of the embodiment will be described as an example with reference to the drawings. FIG. 5 is a cross-sectional view illustrating the fixing device of the embodiment that uses the heater according to the embodiment. As illustrated in FIG. 5, a fixing device 200 has a configuration in which the heater 1 is provided in a bottom of a fixing film belt 201 wound on a support body 202 in a cylindrical shape. The fixing film belt 201 is formed of, for example, a resin material having heat resistance such as polyimide. The pressing roller 203 is disposed at a position facing the heater 1 and the fixing film belt 201. The pressing roller 203 has a heat-resistant elastic material, for example, a silicone resin layer 204 formed on the surface thereof and can rotate around a rotation shaft 205 (a direction P in FIG. 5) while being in press-contact with the fixing film belt 201.

In a toner fixing process, a toner image U1 adhering onto a recording sheet (copy paper) M corresponding to a medium is heated and melted by the heater 1 through the fixing film belt 201 in a contact surface between the fixing film belt 201 and the silicone resin layer 204. As a result, at least a surface portion of the toner image U1 exceeds a melting point so as to be softened and melted. Then, the recording sheet M is separated from the heater 1 and is separated from the fixing film belt 201 on the sheet discharge side of the pressing roller 203 so that a toner image U2 is solidified again while naturally thermally radiating and hence the toner image U2 is fixed to the recording sheet M.

Configuration of Image Forming Apparatus

Figure 6:
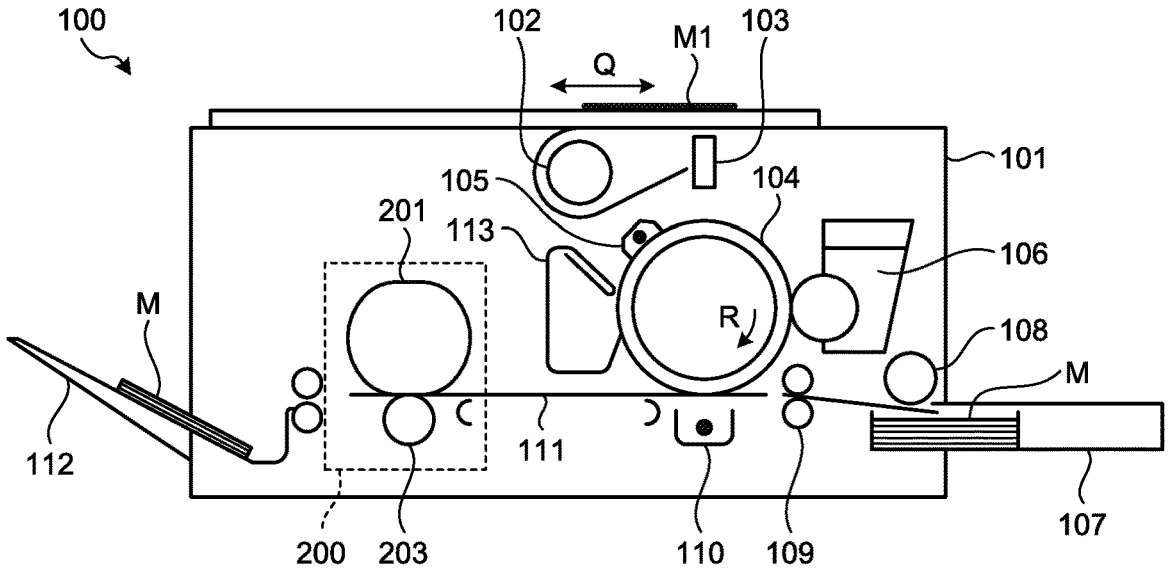
FIG. 6 is a cross-sectional view illustrating an image forming apparatus of the embodiment that uses the heater according to the embodiment.

Finally, an image forming apparatus of the embodiment including the heater 1 of the embodiment will be described as an example with reference to the drawings. FIG. 6 is a cross-sectional view illustrating the image forming apparatus of the embodiment that uses the heater according to the embodiment. Additionally, the image forming apparatus of the embodiment is configured as the copying machine 100. As illustrated in FIG. 6, in the copying machine 100, components including the fixing device 200 are provided inside a casing 101. A document platen which is formed of a transparent material such as glass is attached to the upper portion of the casing 101 and a document M1 corresponding to an object for reading image information therefrom is moved in a reciprocating manner on the document platen (in a direction Q in FIG. 6) so as to scan the document M1.

A luminaire 102 having a light irradiation lamp and a reflection mirror is provided at an upper portion inside the casing 101. The light irradiated from the luminaire 102 is reflected on the surface of the document M1 on the document platen and is slit-exposed onto a photosensitive drum 104 by a short focus small diameter imaging element array 103. In addition, the photosensitive drum 104 is rotatable (in a direction R in FIG. 6). Further, a charger 105 is provided in the vicinity of the photosensitive drum 104 disposed inside the casing 101 and the photosensitive drum 104 is uniformly charged by the charger 105. The photosensitive drum 104 is coated with, for example, a zinc oxide photosensitive layer or an organic semiconductor photosensitive layer. An electrostatic image which is exposed by the short focus small diameter imaging element array 103 is formed on the charged photosensitive drum 104. The electrostatic image is developed by toner formed of resin or the like which is softened and melted by the heating of the developer 106, so that a toner image is formed.

The recording sheet M accommodated in a cassette 107 is transferred onto the photosensitive drum 104 by a feeding roller 108 and a pair of conveying rollers 109 rotating in a press-contact state at the upper and lower positions in synchronization with the toner image on the photosensitive drum 104. Then, the toner image on the photosensitive drum 104 is transferred onto the recording sheet M by a transfer discharger 110. Subsequently, the recording sheet M which is sent from the photosensitive drum 104 toward the downstream side is guided to the fixing device 200 by a conveying guide 111 so as to undergo a heating and fixing process (the above-described toner fixing process) and is discharged to a tray 112. After the toner image is transferred, the toner remaining on the photosensitive drum 104 is removed by a cleaner 113.

In the fixing device 200, the heater 1 is installed so as to be pressed by the silicone resin layer 204 attached to the outer periphery of the pressing roller 203. The heater 1 includes the resistance heating element 12 which is provided in the width direction of the recording sheet M orthogonal to the conveying direction of the recording sheet M so as to have an effective length according to the width (length) of the maximum sheet to be copied by the copying machine 100, that is, a length larger than the width (length) of the maximum sheet. Then, the unfixed toner image on the recording sheet M sent between the heater 1 and the pressing roller 203 is melted by the heat generated from the resistance heating element 12 so that a copy image of characters, symbols, images, and the like appears on the recording sheet M.

Additionally, an example in which the heater 1 of the embodiment is applied as a fixing heater of an image forming apparatus such as the copying machine 100 has been described, but the application of the heater 1 is not limited. The heater 1 of the embodiment may be used as a heat source for heating or warming while being attached to devices such as household electric appliances, precision machines for business use and experiments, equipment for chemical reaction, and the like.

While embodiments of the invention have been described, these embodiments have been presented only by way of examples and are not intended to limit the scope of the invention. The embodiments can be embodied in a variety of other forms and various omissions, substitutions, and modifications in the form of the embodiments described herein can be made without departing from the gist of the invention. The embodiments or modifications included in the scope or gist of the invention are also included in the invention described in claims and its equivalent range.

What is claimed is:

1. A heater comprising:

a substrate which includes a first surface and a second surface located on the side opposite to the first surface, a resistance heating element which is disposed on the first surface; and a thermistor which is disposed on the second surface and does not contain lead, wherein the thermistor contains manganese, cobalt, and any one or both of copper and nickel, and wherein in the thermistor, mass contents of the manganese and the cobalt are larger than mass contents of other components.

2. The heater according to claim 1, wherein in the thermistor, the sum of mass contents of the manganese, the cobalt, the copper, and the nickel is 50 mass % or more and 70 mass % or less.

3. The heater according to claim 2, wherein the thermistor contains ruthenium of 2 mass % or more and 15 mass % or less.

4. The heater according to claim 1, wherein the thermistor contains ruthenium of 2 mass % or more and 15 mass % or less.

5. An image forming apparatus comprising:

the heater according to claim 1 that heats a medium; and a pressing roller which presses the medium heated by the heater, wherein a toner image adhering to the medium is fixed by the heater and the pressing roller.

6. A heater comprising:

a substrate which includes a first surface and a second surface located on the side opposite to the first surface;

a resistance heating element which is disposed on the first surface; and a thermistor which is disposed on the second surface and does not contain lead, wherein the thermistor contains manganese, cobalt, and any one or both of copper and nickel, and wherein in the thermistor, mass contents are larger in order of the manganese, the cobalt, and any one or both of the copper and the nickel.

7. The heater according to claim 6, wherein in the thermistor, the sum of mass contents of the manganese, the cobalt, the copper, and the nickel is 50 mass % or more and 70 mass % or less.

8. The heater according to claim 7, wherein the thermistor contains ruthenium of 2 mass % or more and 15 mass % or less.

9. The heater according to claim 6, wherein the thermistor contains ruthenium of 2 mass % or more and 15 mass % or less.

10. An image forming apparatus comprising:

the heater according to claim 6 that heats a medium; and a pressing roller which presses the medium heated by the heater, wherein a toner image adhering to the medium is fixed by the heater and the pressing roller.

11. A heater comprising:

a substrate which includes a first surface and a second surface located on the side opposite to the first surface;

a resistance heating element which is disposed on the first surface; and a thermistor which is disposed on the second surface and does not contain lead, wherein the thermistor contains ruthenium of 2 mass % or more and 15 mass % or less.

12. The heater according to claim 11, wherein the thermistor contains manganese, cobalt, and any one or both of copper and nickel.

13. An image forming apparatus comprising:

the heater according to claim 11 that heats a medium; and a pressing roller which presses the medium heated by the heater, wherein a toner image adhering to the medium is fixed by the heater and the pressing roller.

* * * * *